US006021795A

United States Patent [19]

Long et al.

[11] Patent Number: 6,021,795

[45] Date of Patent: Feb. 8, 2000

[54] QUICK-ERECTING TENT

[75] Inventors: Norris Richard Long, Wichita; John Patrick Barnett, Derby, both of Kans.

[73] Assignee: The Coleman Company, Inc., Wichita, Kans.

[21] Appl. No.: 08/959,877

[22] Filed: Oct. 29, 1997

[51] Int. Cl.[7] ..... E04H 15/62

[52] U.S. Cl. ..... 135/98; 135/99; 135/132; 135/147; 135/118; 135/119

[58] Field of Search ..... 135/98, 99, 132, 135/133, 134, 135, 136, 147, 148, 151, 118, 119

[56] References Cited

U.S. PATENT DOCUMENTS

| | | | |
|---|---|---|---|
| Re. 29,264 | 6/1977 | Woodward | 296/23 |
| 2,227,554 | 1/1941 | Riordon . | |
| 2,530,765 | 11/1950 | Greenup . | |
| 2,764,765 | 10/1956 | Woodruff . | |
| 2,864,389 | 12/1958 | Smith et al. . | |
| 3,794,054 | 2/1974 | Watts | 135/2 |
| 3,874,397 | 4/1975 | Oberhaus . | |
| 4,071,917 | 2/1978 | Mojica | 5/121 |
| 4,193,413 | 3/1980 | Watts et al. . | |
| 4,827,958 | 5/1989 | Cantwell et al. . | |
| 4,945,936 | 8/1990 | Surrendi | 135/98 |
| 5,197,504 | 3/1993 | Howe . | |
| 5,333,634 | 8/1994 | Taylor | 135/98 |
| 5,404,896 | 4/1995 | Howe . | |
| 5,421,355 | 6/1995 | Cantwell . | |
| 5,771,912 | 6/1998 | Swetish | 135/87 |

*Primary Examiner*—Carl D. Friedman
*Assistant Examiner*—Phi Dieu Tran A
*Attorney, Agent, or Firm*—Kramer Levin Naftalis & Frankel LLP

[57] ABSTRACT

A quick-erecting tent includes a collapsible frame and a canopy that is slidably connected to the frame. When the tent is erected, male and female structures will mate. These structures can be fastened together to prevent the tent from collapsing inadvertently. Stake rings are attached to the canopy using an elastic connection.

14 Claims, 7 Drawing Sheets

Fig. 3
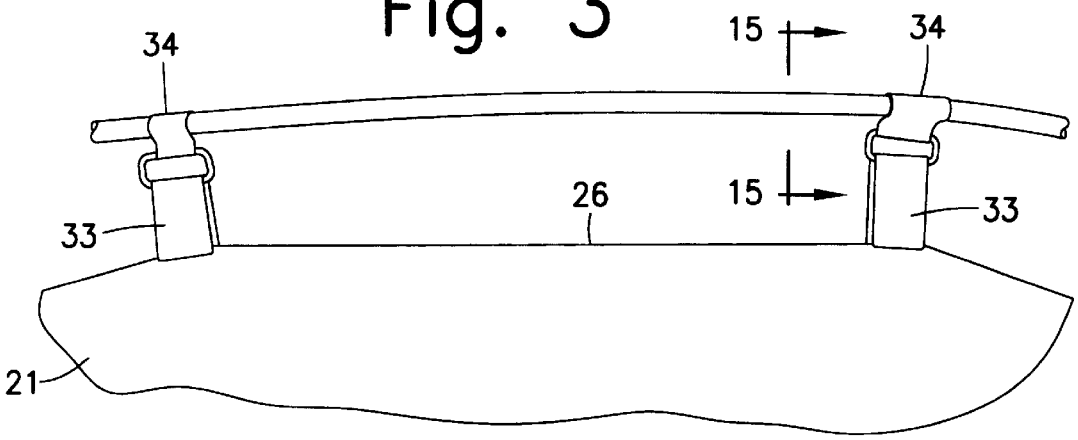
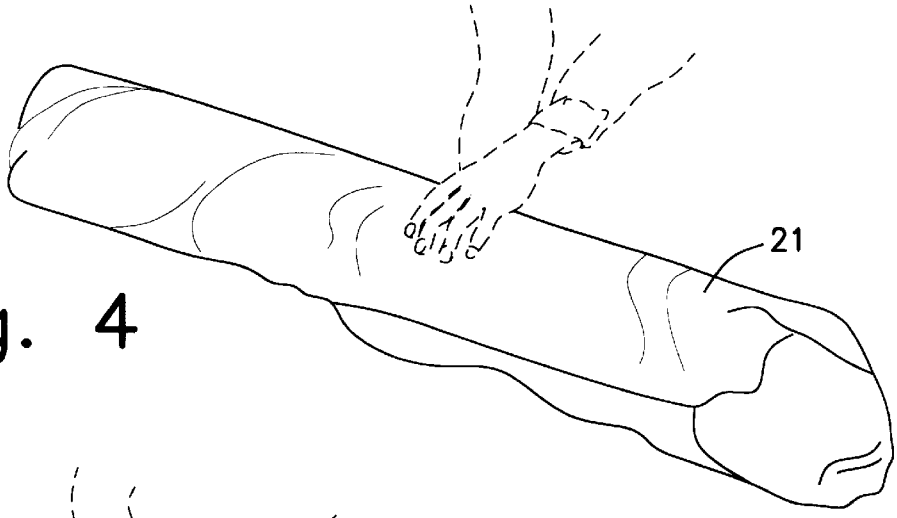
Fig. 4
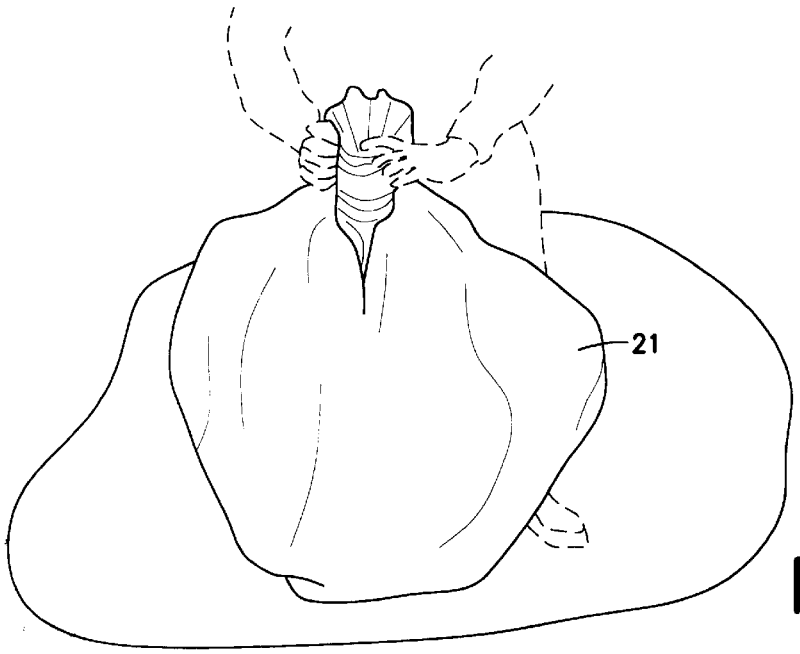
Fig. 5

QUICK-ERECTING TENT

FIELD OF THE INVENTION

The present invention relates to tents, and more particularly, to tents that can be quickly and easily erected by one person and stored compactly.

From the perspective of campers, ease of erecting and breaking down the tent is very important because campers are often eager to continue with their planned activities, and do not want to waste time and effort building tents. This is particularly important to campers who arrive at their campsite after dark or in inclement weather. Ease of set-up by a single person is also advantageous.

Another very important factor is the compactness of the tent when it is collapsed. Tents are very often carried to a camping ground, and a small package makes this much easier to do. Small packages are also easier to store.

DESCRIPTION OF RELATED ART

Tents that can be disassembled and stored in a compact configuration have been available for some time. Typically, these tents use support poles that can be detached from the tent canopy and then either disassembled into multiple parts or folded upon themselves. However, to erect these tents, the pole segments must be sorted and properly reassembled or unfolded, and each pole must then be connected to the tent canopy. It would be preferable to minimize the number of separate parts that must be assembled, thereby reducing the number of steps required to set up the tent.

U.S. Pat. No. 4,945,936, to Surrendi, which is incorporated herein by reference, is directed to an attempt to address this problem with a collapsible, or "umbrella", tent frame. In Surrendi, a tent frame 1 includes four legs, each of which includes a lower section 2 and an upper section 3. The two sections are pivotally connected by a pivot connector 4, and the upper section is pivoted to an upper clevis member of a clevis assembly 5.

The clevis assembly 5 comprises identical upper and lower clevis members 10, 11 and a center post 12. As best seen in FIGS. 2 and 5 of Surrendi, the center post 12 has a main body 18 diameter and smaller diameter upper and lower portions 19, 21. The lower end is secured to the lower clevis member 11.

Each upper leg section 3 is provided with a pivot member 27 at a point intermediate its length. Radial brace members 28 each have one end pivoted to one of members 27 and the other end pivoted to the lower clevis member 11. The positions of members 27 and the length of members 28 are such that when the tent is erected, as seen in FIG. 1, the lower clevis member 11 is forced upwardly, so that the upper portion 19 of the center post 12 is received in a through-bore 14 of the upper clevis member.

While this frame provides umbrella-like collapsibility, numerous problems remain. First, because the frame is disposed within the tent canopy, it is relatively inaccessible, which can make it difficult to raise and lower the tent. Further, with Surrendi's configuration, it would be difficult to incorporate a rainfly (i.e., an outer canvas) that is separated from the inner canopy to increase water and wind resistance.

Yet another drawback of Surrendi is that it relies only on the tension of the canvas to hold the center post 12 in the bore 14 of the upper clevis member. Because no other mechanism is used to hold the center post 12 in the bore 14, if the center post were to be pulled away from the bore with sufficient force to overcome the tension of the canvas, the tent would collapse. Since the tent is intended for use in unpredictable environs, this can cause serious problems.

SUMMARY OF THE INVENTION

The present invention advantageously provides a tent which can be stored in a compact configuration and can be erected quickly and easily by one person.

According to one aspect of the present invention, a tent that includes a collapsible frame is provided. A plurality of fasteners are slidably connected to the frame, and a canopy is connected to the fasteners so that the canopy is supported by the frame when the frame is erected. The bottoms of the legs of the frame are connected to respective locations on the canopy, and stake rings are elastically connected to the canopy.

According to another aspect of the invention, a tent is provided. The tent includes a primary support frame having at least three support legs extending from and pivotally secured to a primary hub. Each support leg has an upper leg portion and a lower leg portion. The tent also includes a secondary support frame including at least three leg braces extending from and pivotally secured to a secondary hub, with each leg brace having an outer end pivotally secured to a corresponding support leg. A canopy is disposed within these two support frames, and slidably attached to at least one of the support frames. A plurality of straps with an opening, a stake ring, and an elastic portion therebetween extend from the bottom of the canopy. The opening receives the bottom of a leg, which is held in place by a fastener, and the stake ring receives a stake to secure the tent. The primary hub and the secondary hub have mating structures that mate when the hubs are moved together.

According to another aspect of the invention, a tent is provided. The tent includes a primary support frame having at least three support legs extending from and pivotally secured to a primary hub. Each support leg has an upper leg portion and a lower leg portion. The tent also includes a secondary support frame including at least three leg braces extending from and pivotally secured to a secondary hub, with each leg brace having an outer end pivotally secured to a corresponding support leg. A canopy is disposed within these two support frames, and slidably attached to at least one of the support frames. A lower end of each leg is secured to peripheral locations of the canopy. The primary hub and the secondary hub have mating structures that mate when the hubs are moved together, and a fastener keeps the hubs together when the mating structures are mated.

According to another aspect of the invention, a tent is provided. The tent includes a primary support frame having at least three support legs extending from and pivotally secured to a primary hub. Each support leg has an upper leg portion hingedly attached to a lower leg portion. The tent also includes a secondary support frame including at least three leg braces extending from and pivotally secured to a secondary hub, with each leg brace having an outer end pivotally secured to a corresponding support leg. A canopy is disposed within these two support frames, and slidably attached using C-shaped clips to at least one of the support frames. A lower end of each leg is secured to peripheral locations of the canopy. The primary hub and the secondary hub have mating structures that mate when the hubs are moved together.

BRIEF DESCRIPTION OF THE DRAWINGS

The present invention will be explained in conjunction with an illustrative embodiment shown in the accompanying drawing, in which:

FIG. 3 is a detailed perspective view of portions of a support leg and the tent canopy, and two slidable support clips, of the tent shown in FIG. 1;

FIG. 4 is a perspective view of the tent shown in FIG. 1, collapsed and rolled up for storage;

FIG. 5 illustrates an early step of erecting the tent shown in FIG. 1;

DETAILED DESCRIPTION OF THE PREFERRED EMBODIMENTS

Figure 1:
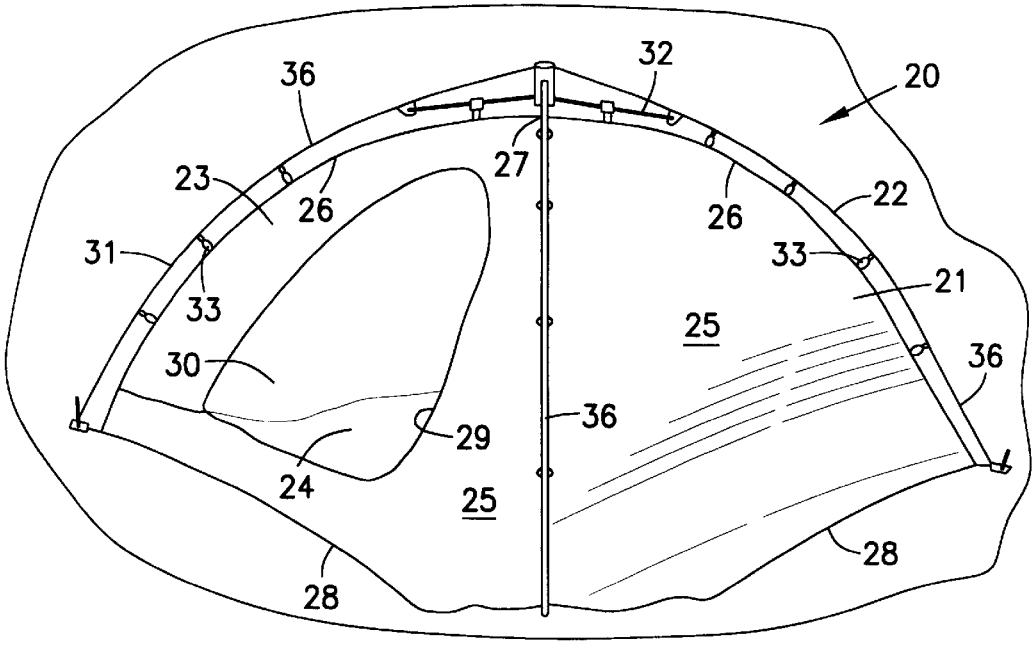
FIG. 1 is a partial perspective view of a tent formed in accordance with a preferred embodiment of the present invention.

FIG. 1 illustrates a tent 20 of a preferred embodiment of the present invention in its erected position. The tent includes a canopy 21 and a supporting frame 22. The canopy 21 can be formed from conventional tent fabric including, for example, nylon and canvas. The illustrated canopy includes a substantially dome-shaped top 23 and a floor 24. Preferably, the top includes four substantially triangular panels 25 connected along seams 26 which converge at an apex 27. The bottom edges 28 of the panels are connected to the floor 24, forming a substantially rectangular bottom periphery. The panels and bottom are preferably stitched together, but can also be connected by any other conventional means. One of the panels is provided with an opening 29 that can be closable by a flap 30. This four panel canopy is preferred for use with the four leg supporting frame 22 discussed herein. It will be appreciated that the canopy 21 can be varied to accommodate supporting frames 22 having different dimensions or a different number of legs.

Figure 2:
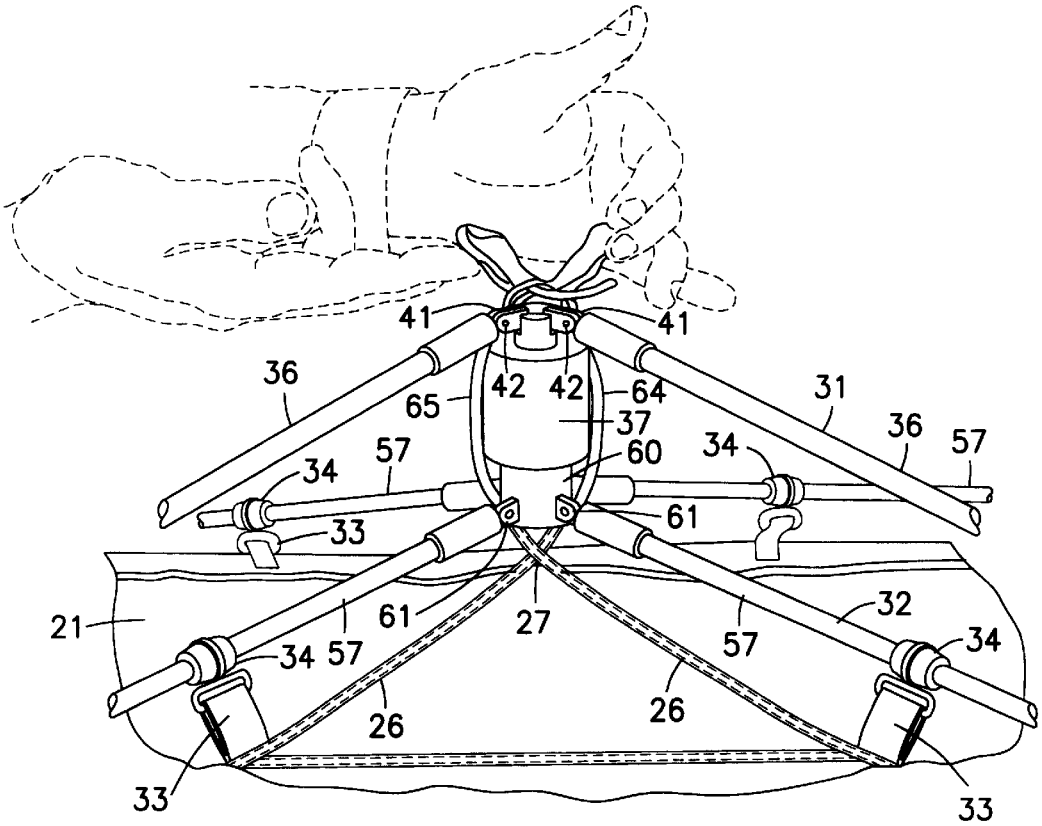
FIG. 2 is a detailed perspective view of the top of the tent shown in FIG. 1.
Figure 15:
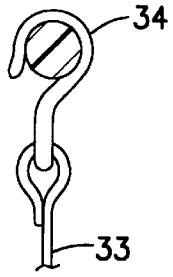
FIG. 15 is a sectional view taken along the line 15—15 of FIG. 3.

The tent canopy 21 is supported in the erected position shown in FIG. 1 by the supporting frame 22. The frame 22 includes a primary support frame 31 and a secondary support frame 32. As best seen in FIGS. 2, 3 and 15, the canopy 21 is slidably attached to the primary and secondary support frames 31 and 32. In the preferred embodiment, clips 34 slidably attach the canopy to the support frames and allow sliding along the direction of the frame members. The clips 34 are preferably formed of plastic, but can be also be formed of metal, wood, or other appropriate materials. As best seen in FIG. 15, the preferred clips 34 are C-shaped to provide the added advantage of being snap-fittable onto and off of the frame 22. These C-shaped clips facilitate the initial assembly of the tent by the manufacturer. Of course, this can be alternatively achieved by any of a number of chips or like devices which can be snapped onto the frames for slidable engagement.

The chips in this embodiment are secured to the canopy by tabs 33, which may be formed from woven fabric. The tabs may be inserted through the clips 34 and stitched into the seams 26 of the canopy 21. Alternatively, the clips 34 may each be provided with an integral base tab which can be affixed directly to the canopy 21, whether stitched into a seam or inserted through a specially provided opening.

Alternatively, the canopy 21 can be secured to the supporting frame 22 by means other than the tabs and clips shown. For example, the canopy 21 could be secured by complementary tabs which snap or hook together around the frame 22, hooks or clips attached directly to the canopy, or sleeves or loops disposed on the outside of the canopy. Other suitable arrangements can be readily envisioned. It is important, however, for the connection between the canopy 21 and the frame 22 to be slidable.

The primary support frame 31 includes four support legs 36, with which the seams of the canopy 21 are preferably aligned. The upper end of each support leg 36 is pivotally attached to a primary hub 41 (in this embodiment, a clevis) by a pin 42 or the like. Other suitable means of pivotal engagement can be used, including, but not limited to, ball joints and sturdy flexible straps.

Figure 13B:
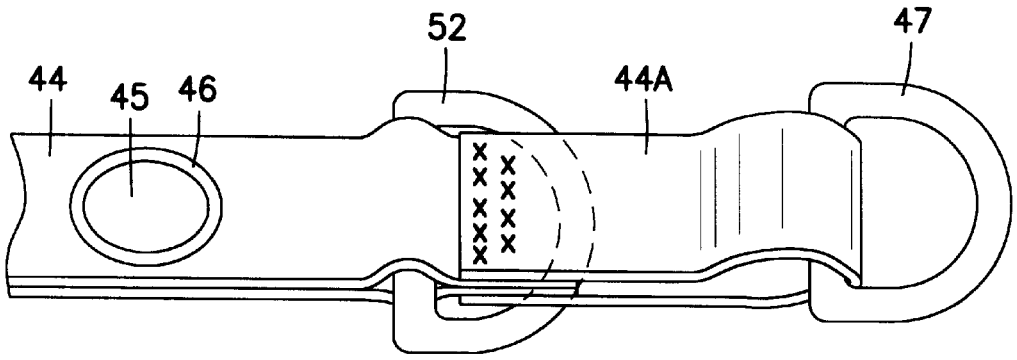
FIG. 13B is a detailed, disassembled perspective view of a corner of the tent canopy and an end of a support leg of a tent in accordance with another preferred embodiment of the present invention.

The bottom end of each support leg 36 is connected to a respective corner of the canopy 21. Preferably, a strap 44 (best seen in FIGS. 13A, 13B and 14) for receiving the support leg extends from each corner of the canopy 21. Each strap 44 is preferably formed of a suitably sturdy material, such as woven fabric. Each strap 44 can be provided with an opening 45, which can be reinforced by a metal grommet 46 or the like. It will be appreciated that alternate structures can be provided to serve the function of the grommetted opening 45.

The bottom end of each support leg 36 preferably includes a cylindrical enlargement 48 and a reduced diameter end portion 49 which fits through the opening 45 in the strap. An E-ring 50 or other suitable clip can snap into an annular groove 51 in the end portion 49 to secure the grommet 46 between the enlargement 48 and the E-ring 50. Alternatively, the support legs 36 can be secured to the corners of the canopy 21 by other means. For example, an additional E-ring or the like can be used in place of the enlargement 48, or screw-on end cap could be used in place of the E-ring 50.

Figure 13A:
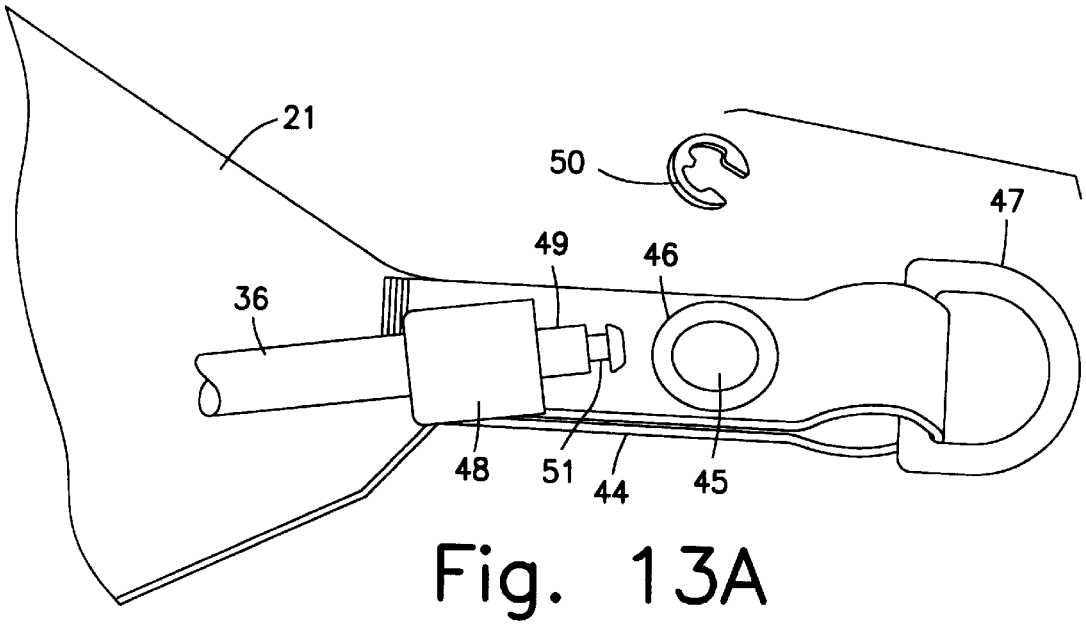
FIG. 13A is a detailed, disassembled perspective view of a corner of the tent canopy and an end of a support leg of the tent shown in FIG. 1.
Figure 14:
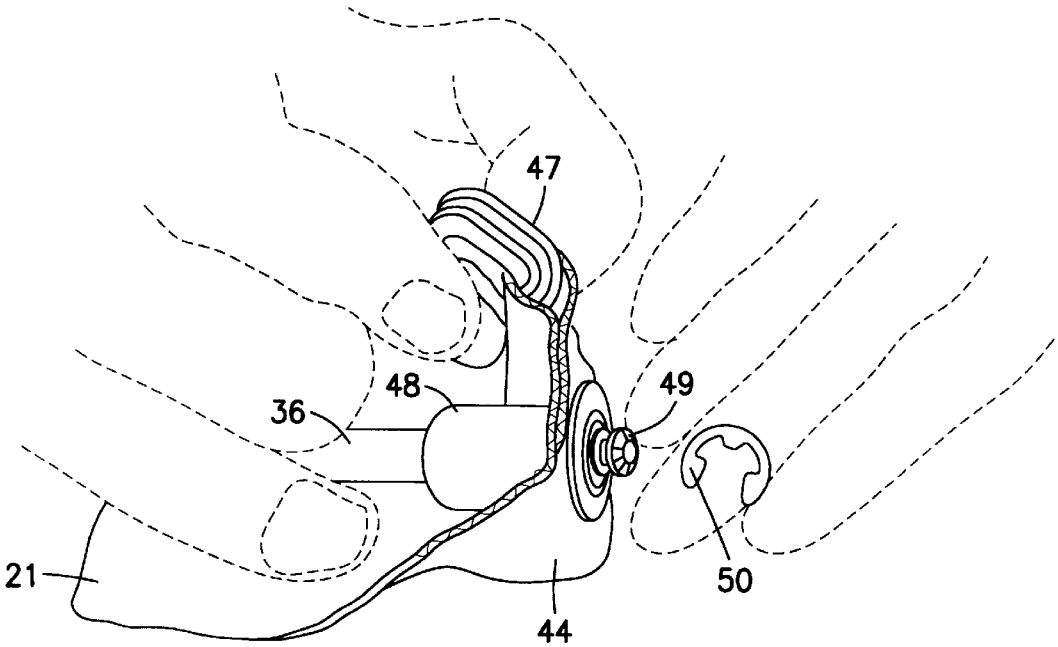
FIG. 14 illustrates the attachment of the end of the support leg and the corner of the tent canopy shown in FIG. 13.

Preferably, a stake ring 47 is provided at the end of each strap 44 (shown in FIG. 13A). In the embodiment shown, a D-ring is employed as the stake ring 47. A tent stake can be driven through this stake ring to secure the canopy 21 to the ground or other support surface. Alternative configurations of stake rings 47 may also be used in place of the D-ring shown in the drawings. For example, a circular ring may be provided at the end of the strap 44. As yet another alternative, a second opening can be provided in the strap itself and reinforced with a grommet or the like, similar to the opening 45 and grommet 46. Numerous other stake ring configurations can be readily envisioned, including stake rings with non-circular shapes, such as squares or rectangles. The important thing is that the stake ring must be able to secure the tent when a stake is driven into the stake ring.

Optionally, as shown in FIG. 13B, an elastic span 44A can be disposed at each corner of the tent between the opening 45 and the stake ring 47. This permits the bottom end 49 of each support leg 36 to move around even though the tent corners are staked in place, which eases the erecting and collapsing of the tent. The elastic span 44A may be sewn to the end of strap 44, or connected in another suitable way. The elastic span 44A may be constructed of a suitably strong fabric with rubber strands woven into the fabric. The elastic span 44A stretches when the tent is being erected, and eventually returns to approximately its original length.

When an elastic span 44A is used, a second stake ring 52 may be added to the strap on the canopy side of the elastic span. This second stake ring 52 can then be used if a non-elastic stake connection is desired. The camper can drive a stake through the first stake ring 47 when initially erecting the tent, and then drive a stake through the second stake ring 52 to further secure the tent after the tent has been erected.

FIG. 4 shows a compact configuration in which the tent is stored. To erect the tent, the camper unrolls the canopy 21, and raises the tents to the position shown in FIG. 5. He then unfolds the tent to the position shown in FIG. 6. It is apparent from this view that each support leg 36 includes an upper leg portion 53 hinged to a lower leg portion 54. As discussed, the canopy 21 is connected to the bottom of the lower leg portions 54. Thus, unfolding the support legs 36 in this manner will spread the canopy 21 on the ground G.

Figure 6:
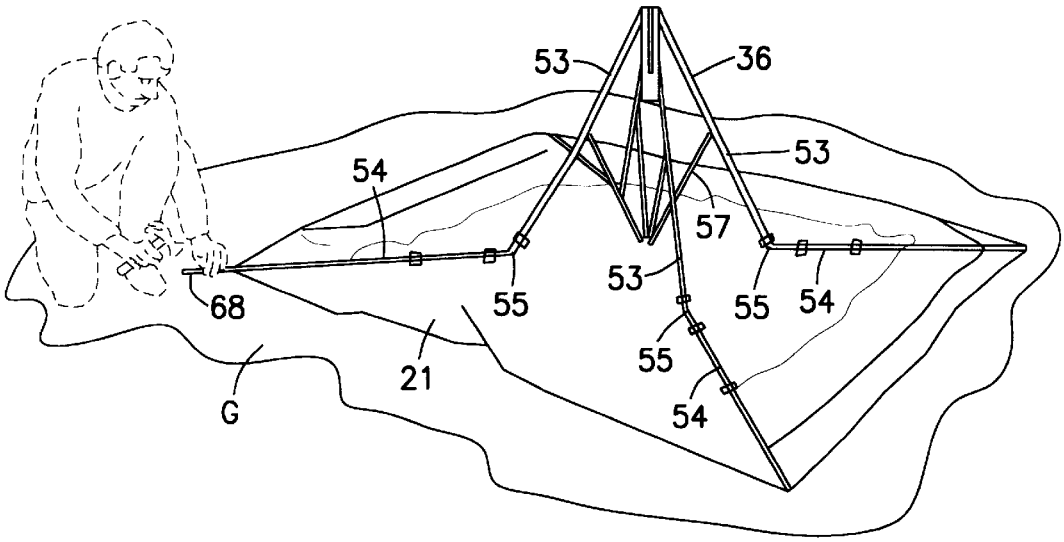
FIG. 6 illustrates the tent of FIG. 1, partially erected.
Figure 7:
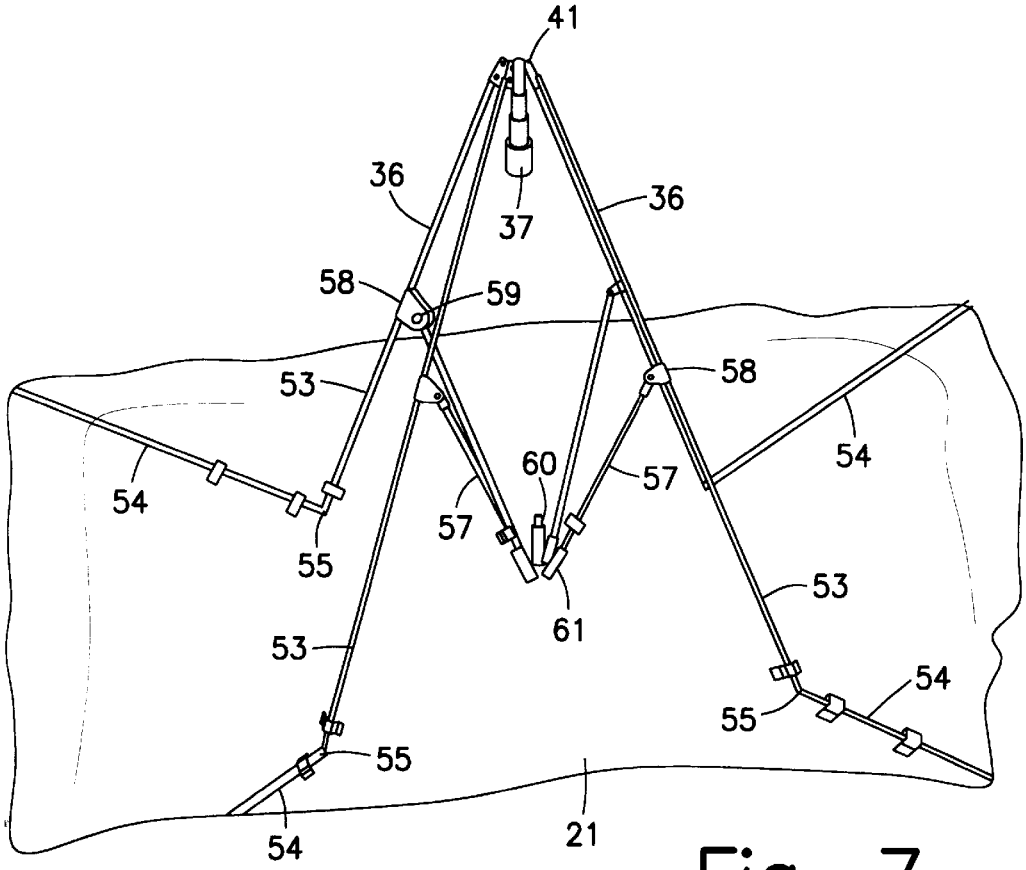
FIG. 7 is a detailed view of a portion of the tent as illustrated in FIG. 6.

In the position shown in FIGS. 6 and 7, the upper leg portions 53 form a self-supporting pyramid. Preferably, the lower leg portions 54 are hingedly connected to the upper leg portions 53 using hinges 55. These hinges permit the upper and lower leg portions 53 and 54 to pivot relative to one another within a range of between about 0° and about 180°, but do not let the leg portions rotate beyond about 180°.

With the tent in this position, before erecting the tent further, the corners of the tent may be staked to the ground G by driving stakes 68 through the stake rings 47 (shown in FIGS. 13A and 13B).

As discussed, the upper end of each upper leg portion 53 is connected to the primary hub 41, and the lower end of each lower leg portion 54 is attached to a respective corner of the canopy 21. These leg portions 53 and 54 are preferably glass-filled nylon rods, but can be formed of other suitable material, including, but not limited to, metal and wood.

A secondary support frame is provided inside the pyramid of the primary support frame. The secondary support frame includes four leg braces 57, each corresponding to one of the support legs 36 of the primary support frame. The leg braces may be formed of the same materials as the support legs 36. The inner end of each leg brace 57 is pivotally connected to a central secondary hub 61 (in this embodiment a clevis). The outer end of each leg brace 57 is pivotally connected, by way of a connector 58, to a respective one of the upper leg portions 53 of the support legs 36. Preferably, each connector 58 includes a pin that allows the leg brace 57 to pivot.

Figure 8:
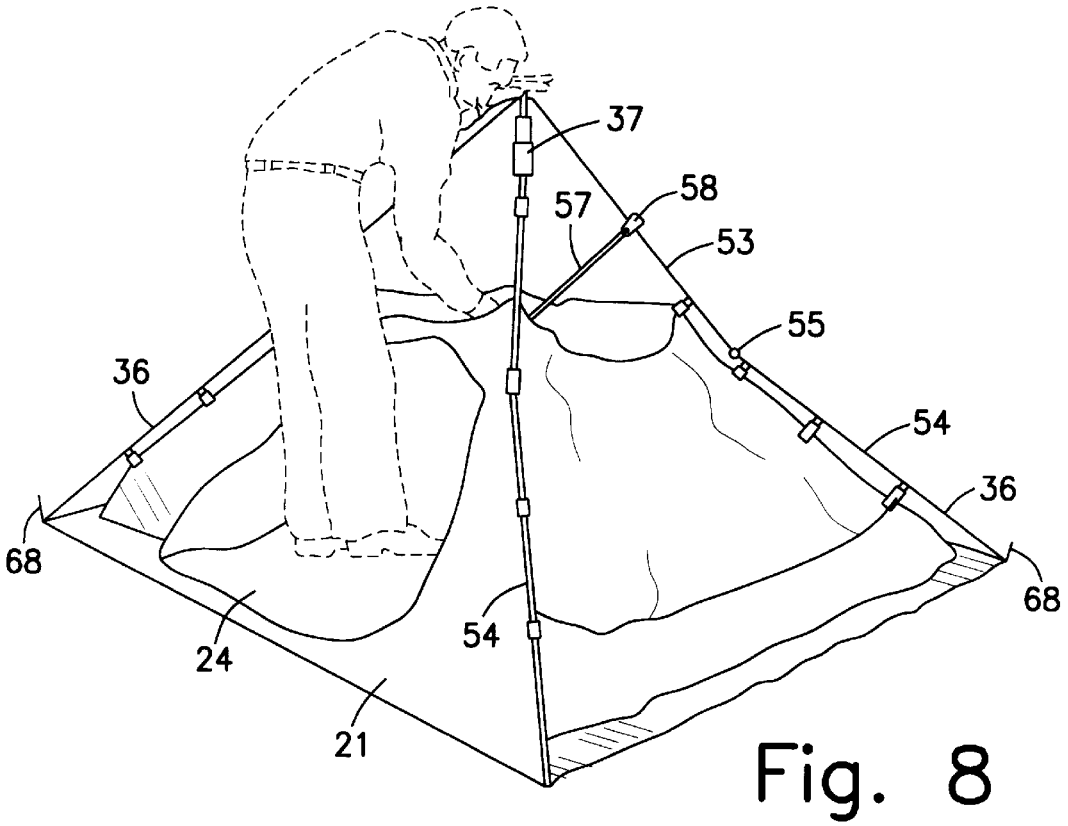
FIG. 8 illustrates the tent of FIG. 1 with partially raised primary and secondary support frames.
Figure 9:
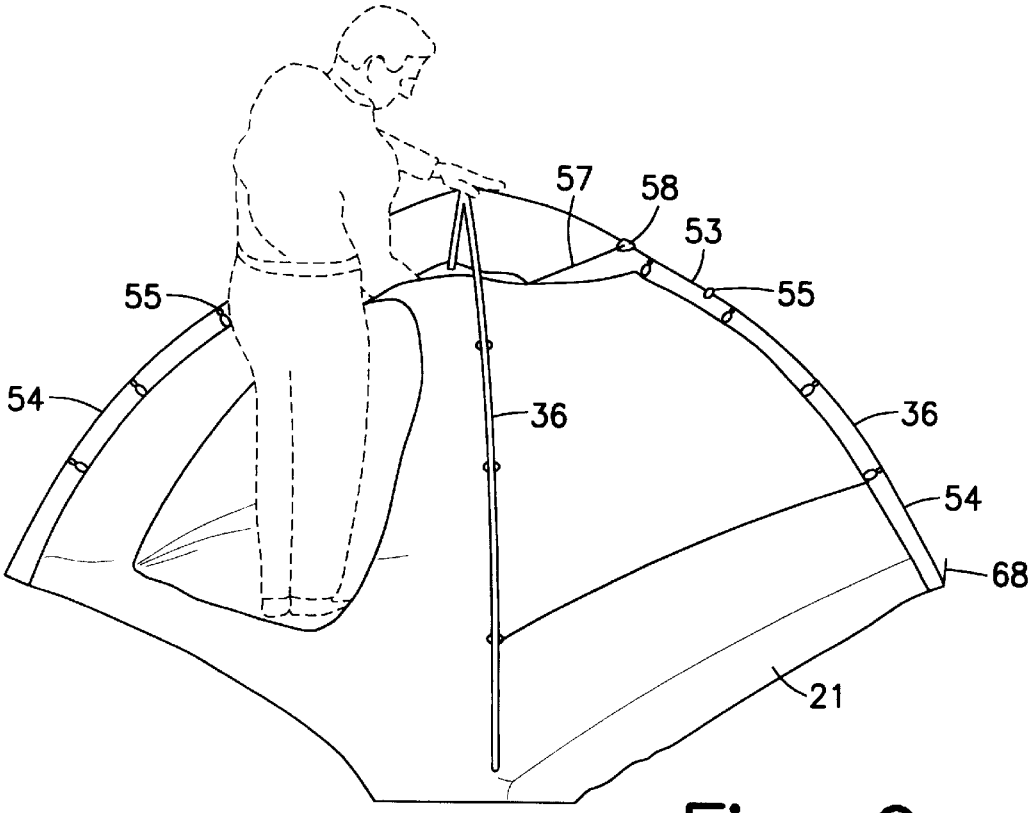
FIG. 9 illustrates the tent of FIG. 1 with a fully raised primary support frame and the secondary support frame in a below-horizontal position.

FIGS. 8 and 9 show the tent being raised further. To accomplish this, the secondary hub 61 (not visible in these views) is lifted with one hand, which raises the inner ends of the leg braces 57. Meanwhile, the primary hub 41 (not shown) is steadied with the other hand. As the inner ends of the leg braces 57 are raised, the outer ends of the leg braces 57 will be spread apart, pushing the support legs 36 apart.

When the leg braces 57 arrive at the position shown in FIG. 8, the leg braces 57 are approximately perpendicular to the upper leg portions 53. In this position, the secondary hub 61 is spaced a maximum distance from the support legs 36, the canopy hook 34 on each leg brace 57 is still located near the inner end of the leg brace, and the support frame is not yet self-supporting.

As the inner ends of the leg braces 57 are raised further, the upper leg portions 53 are pushed further apart. This will cause the upper and lower leg portions 53 and 54 to pivot at the hinges 55, straightening the support legs 36. Once the support legs 36 are approximately straight, the hinges 55 will not open any further, as explained above. The clips 34 attaching the canopy to the support legs 36 will slide along the upper and lower legs 53 and 54 due to the tension created between the legs and the canopy 21. Because the bottoms of the lower leg portions 54 are connected to the canopy 21, which is connected to a non-elastic floor 24, as the upper leg portions 53 are forced further out by the leg braces, the support legs 36 will bow out as illustrated in FIG. 9.

Figure 10:
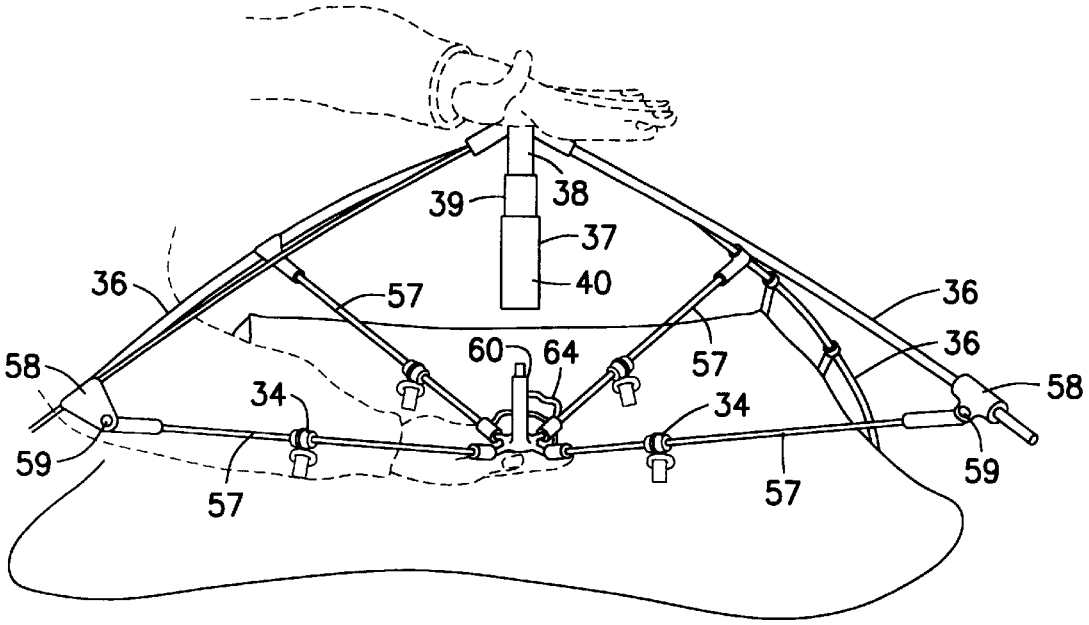
FIGS. 10, 11, and 12 sequentially illustrate movement of the secondary frame from the below horizontal position shown in FIG. 9 to an above-horizontal position.
Figure 11:
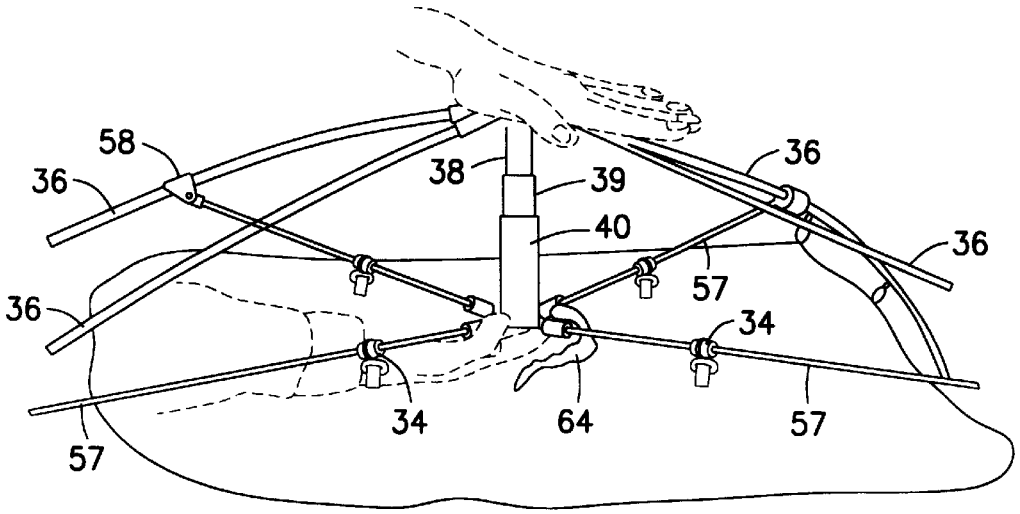
Figure 12:
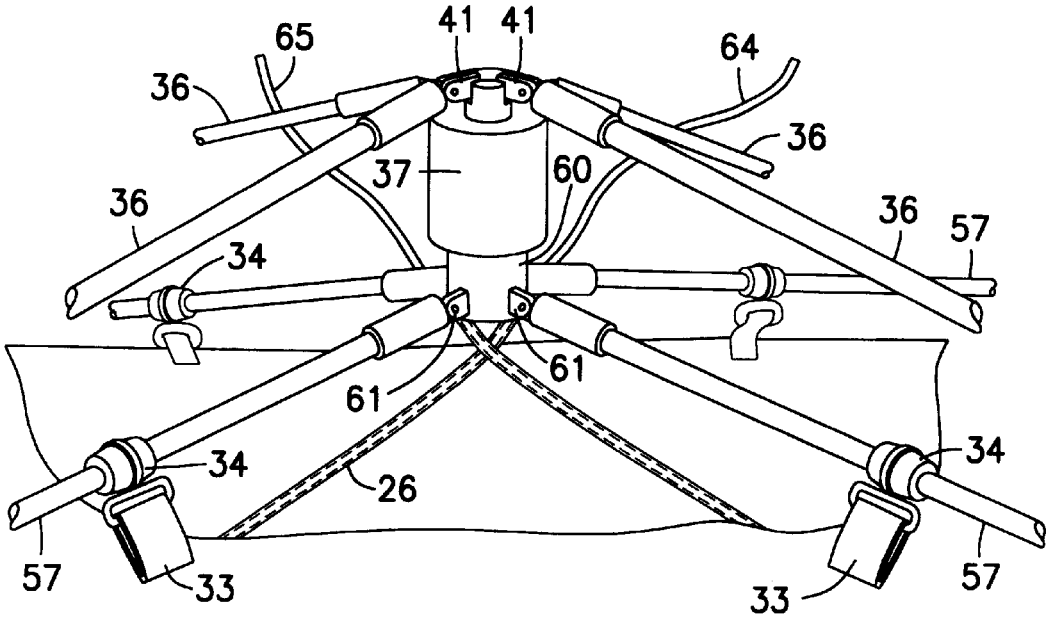

FIGS. 10, 11, and 12 show a more detailed view of the upper portion of the support frame as it is being moved into its erect position.

The sliding attachments between the canopy 21 and the two support frames are an important aspect of the present invention. The clips 34 are free to slide along the support legs 36 and the leg braces 57. This allows the canopy 21 to slide with respect to the frame, which permits the legs to be folded and unfolded without interference from the canopy 21. Preferably, starting from the center of the canopy, one clip 34 is attached to each leg brace 57, one clip 34 is attached to each upper leg portion 53 between the hinge 55 and the connector 58, and three clips 34 are attached to each lower leg portion 54.

As the inner ends of the leg braces 57 are raised closer to the upper ends of the support legs 36, the inner ends will rise above the outer ends of the leg braces 57. As soon as this occurs, the tension from the canopy squeezing the support legs 36 together will start to urge the secondary hub 61 upwards, towards the primary hub 41. In addition, as the secondary hub 61 approaches the primary hub 41, the tension from the canopy 21 causes the canopy clips 34 on the leg braces 57 to slide outward on the leg braces.

A tube 37 depends from the primary hub 41. Preferably, the tube 37 is a three part telescoping tube including a top tube 38 having a closed top, an intermediate tube 39, and a bottom tube 40. An elongated pin 60 extends upward from the secondary hub 61. The pin 60 and telescoping tube 37, which can be formed of metal, plastic, or another suitable material, are engageable with each another.

The telescoping tube 37 extends downwardly from the center of the primary hub 41 for a substantial distance to receive and guide the pin 60 as the pin is raised. As the pin 60 moves upwards, the tube 37 collapses, as shown in FIG. 12. In this position, the support frame is self-supporting. The telescoping tube 37 retains the pin 60 and keeps the leg braces 57 centered with respect to the support legs 36. The telescoping feature of the tube 37 aids in the mating with the pin 60, but it is not required.

While the drawings show a pin 60 mating with a tube 37, alternative male and female mating structures may also be used. For example, a slot may be mated with a matching ridge, or a convex dome may be mated with a concave bowl. Numerous other mating structures can be readily envisioned. In addition, while the drawings show a male pin 60 attached to the secondary hub 61, and a female tube 37 attached to the primary hub 41, the male and female structures can be interchanged so that the male structure is attached to the primary hub 41 and the female structure is attached to the secondary hub 61.

When the tent is erect as illustrated in FIGS. 1 and 2, the pin 60 is seated in the telescoping tube 37. The tension from the tent canopy 21 is translated to the leg braces and the support legs 36 through the tabs 33 and sliding clips 34. The leg braces 57 of the secondary support frame extend out and down from the secondary hub 61 from which the pin 60 extends.

In this position, the leg braces 57 push outward against the support legs 36 and prevent the support legs 36 from collapsing inwardly. The leg braces 57 are retained in the raised position by tension from the canopy 21 which squeezes the support legs 36 and the outer ends of the leg braces 57 together, while the telescoping tube 37 holds the secondary hub 61 and the inner ends of the leg braces 57 in place. As long as the secondary hub 61 remains in place next to the primary hub 41, the frame will remain erect and support the canopy 21.

FIG. 2 depicts the top of the support frame when the tent is assembled in its self-supporting position. Optionally, to ensure that an unforeseen force does not pull the secondary hub 61 away from the primary hub 41, which would cause the tent to collapse, a fastener can be added to hold the hubs 41 and 61 together. For example, straps 64 and 65 can be permanently secured to the apex of the canopy 21 and tied around the interconnected pin 60 and telescoping tube 37. This would prevent the pin 60 from separating from the telescoping tube 37, holding the leg braces 57 in their bracing position. Alternative fasteners may also be used in place of straps 64 and 65. For example, a cotter pin may be inserted into a hole drilled through the hubs, or the two hubs may be clamped together. Numerous other alternative fasteners can be readily envisioned.

Tents in accordance with the present invention can be erected quickly and easily by one person. It is possible to erect these tents from the position shown in FIG. 4 to the position shown in FIG. 1 in under 60 seconds, including time for staking the corners of the tent.

Once the tent has been erected, as described above, it can be used just like any conventional tent. After the tent is used, it can be collapsed and folded for storage by reversing the procedure used to erect the tent. More specifically, the straps 64 and 65 are untied, and the pin 60 and the inner ends of the leg braces 57 are pulled downwardly away from the telescoping tube 37. Once the leg braces 57 pass below horizontal, the tension from the canopy 21 transmitted through the leg braces 57 will tend to push the inner secondary hub 61 downward, away from the primary hub 41. In this position, the leg braces 57 no longer support the support legs 36, and the support legs 36 will collapse under the weight of the canopy 21.

The primary and secondary support frames can then be collapsed for storage by folding the pivoting leg portions 53 and 54 of the support legs 36 against one another and against the leg braces 57. As this is done, the canopy clips 34 slide relative to the support legs 36 and leg braces 57.

Once the frame is collapsed, the canopy 21 can be wrapped around the frame so that the tent can be stored in the compact configuration shown in FIG. 4.

While the present invention has been described above with reference to the specific embodiments, it is to be understood that the invention is not limited to those precise embodiments. Changes and modifications can be effected without departing from the scope or spirit of the present invention.

What is claimed is:

1. A quick-erecting tent comprising:

a frame having a plurality of legs, each leg having a bottom, the frame capable of being alternately erected and collapsed;

a plurality of fasteners slidably connected to the frame;

a canopy connected to the fasteners so that the canopy is supported by the frame when the frame is erected, wherein each leg bottom is connected to the canopy; and a plurality of stake rings, each of the stake rings being elastically connected to the canopy with a stretchable material which, upon release, eventually returns to approximately its original length.

2. A quick-erecting tent comprising:

a primary support frame including at least three support legs extending from and pivotally secured to a primary hub, each support leg including an upper leg portion and a lower leg portion;

a secondary support frame including at least three leg braces extending from and pivotally secured to a secondary hub, each leg brace having an otter end pivotally secured to a corresponding support leg;

a canopy disposed within the primary and secondary support frames, and slidably attached to at least one of the primary and secondary support frames;

a plurality of straps extending from a bottom edge of the canopy, each of the straps having an opening through which a lower end of a respective lower leg portion is secured, a first stake ring through which a tent stake can he driven to secure the tent to a supporting surface, and an elastic portion between the opening and the stake ring, wherein the elastic portion is stretchable and, upon release, eventually returns to approximately its original length; and a plurality of fasteners, each of the fasteners securing a respective lower end of a respective lower leg portion to the opening, wherein the primary hub has a first mating structure, and the secondary hub has a second mating structure adapted to mate with the first mating stricture when the primary hub and the secondary hub are moving together and wherein each of the plurality of straps has a second stake ring attached between the opening and the elastic portion.

3. A quick-erecting tent comprising:

a primary support frame including at least three support legs extending from and pivotally secured to a primary hub, each support leg including an upper leg portion and a lower leg portion;

a secondary support frame including at least three leg braces extending from and pivotally secured to a secondary hub, each leg brace having an outer end pivotally secured to a corresponding support leg;

a canopy disposed within the primary and secondary support frames, and slidably attached to at least one of the primary and secondary support frames;

a plurality of straps extending from a bottom edge of the canopy, each of the straps having an opening through which a lower end of a respective lower leg portion is secured, a first stake ring through which a tent stake can he driven to secure the tent to a supporting surface, and an elastic portion between the opening and the stake ring, wherein the elastic portion is stretchable and, upon release, eventually returns to approximately its original length; and a plurality of fasteners, each of the fasteners securing a respective lower end of a respective lower leg portion to the opening, wherein the primary hub has a first mating structure, and the secondary hub has a second mating structure adapted to mate with the first mating structure when the primary hub and the secondary hub are moving together and wherein each of the plurality of straps has a second stake ring between the opening and the elastic portion, the canopy is slidably attached with C-shaped clips to each leg brace, to each upper leg portion, and to a plurality of locations along each lower leg portion, and each upper leg portion is hingedly secured to a respective lower leg portion.

4. A quick-erecting tent comprising:

a primary support frame including at least three support legs extending from and pivotally secured to a primary hub, each support leg including an upper leg portion and a lower leg portion, the primary hub having a first mating structure;

a secondary support frame including at least three leg braces extending from and pivotally secured to a secondary hub, each leg brace having an outer end pivotally secured to a corresponding support leg, the secondary hub having a second mating structure adapted to mate with the first mating structure when the primary hub and the secondary hub are moved together;

a canopy disposed within the primary and secondary support frames, and slidably attached to at least one of the primary and secondary support frames, wherein a lower end of each lower leg portion is secured to a respective one of a plurality of peripheral locations of the canopy; and a fastener fastening the primary hub to the secondary hub when the first and second mating structures are mated, wherein the fastener comprises a plurality of tie straps attached to the canopy and tie the hubs together when the mating structures are mated.

5. The tent according to claim 4, wherein the canopy is slidably attached to the lower leg portions and to the leg braces.

6. The tent according to claim 4, wherein the canopy is slidably attached to each leg brace, to each upper leg portion, and to a plurality of locations along each lower leg portion.

7. The tent according to claim 4, wherein the canopy is slidably attached using C-shaped clips that are affixed to the canopy and slidably attached to the at least one of the primary and secondary support frames.

8. The tent according to claim 4, wherein the first mating structure comprises a telescoping tube having a base tube portion attached to the primary hub, and at least one open tube portion telescopingly connected to the base tube portion, and the second mating structure comprises a pin.

9. The tent according to claim 4, wherein the lower end of each leg portion is secured to the canopy using a strap and a leg fastener, each strap extending from a bottom edge of the canopy, each strap having an opening to which the lower end of a respective lower leg portion is secured by the leg fastener.

10. The tent according to claim 9, wherein each strap has a stake ring through which a Lent stake can be driven to secure the tent to a supporting surface.

11. The tent according to claim 10, wherein a portion of each strap between the opening and the stake ring is elastic.

12. The tent according to claim 11, further comprising a second stake ring attached to the strap between the opening and the elastic portion of the strap.

13. The tent according to claim 4, wherein each upper leg portion is hingedly secured to a respective lower leg portion.

14. The tent according to claim 4, wherein the canopy is slidably attached with C-shaped clips to each leg brace, to each upper leg portion, and to a plurality of locations along each lower leg portion, the first mating structure comprises a telescoping tube having a base tube portion attached to the primary hub, and at least one open tube portion telescopingly connected to the base tube portion, the second mating structure comprises a pin, the fastener comprises a plurality of tie straps attached to the canopy and adapted to tie the hubs together when the mating structures are mated, the lower end of each leg portion is secured to the canopy using a strap and a leg fastener, each strap extending from a bottom edge of the canopy, each strap having an opening to which the lower end of a respective lower leg portion is secured by the leg fastener, each strap having a stake ring through which a tent stake can be driven to secure the tent to a supporting surface, and each upper leg portion is hingedly secured to a respective lower leg portion.

* * * * *